US005729937A

United States Patent [19]

Mantelli

[11] Patent Number: 5,729,937

[45] Date of Patent: Mar. 24, 1998

[54] MODULAR GUTTER FOR DRAINAGE CHANNELS

[75] Inventor: Giulio Mantelli, Boissano, Italy

[73] Assignee: Edil Plast S.r.l., Forli', Italy

[21] Appl. No.: 794,633

[22] Filed: Feb. 3, 1997

[30] Foreign Application Priority Data

Feb. 9, 1996 [IT] Italy ..... BO960018 U

[51] Int. Cl.[6] ..... E04C 2/52

[52] U.S. Cl. ..... 52/220.5; 52/11; 52/169.7; 404/4

[58] Field of Search ..... 52/220.5, 11, 169.7; 404/4; 405/118, 124

[56] References Cited

U.S. PATENT DOCUMENTS

| | | | |
|---|---|---|---|
| 3,394,509 | 7/1968 | McKinley | 52/220.5 |
| 3,465,654 | 9/1969 | Fox | 404/4 |
| 4,751,945 | 6/1988 | Williams | 404/4 X |
| 4,815,888 | 3/1989 | Stegmeier | 404/4 |
| 5,181,793 | 1/1993 | Dekel | 52/11 X |

FOREIGN PATENT DOCUMENTS

| | | |
|---|---|---|
| 0542701 A1 | 11/1991 | European Pat. Off. . |
| 0 542 701 A1 | 5/1993 | European Pat. Off. . |
| 88 16 079 U | 4/1989 | Germany . |
| 89 10 414 U | 12/1989 | Germany . |
| 1 594 951 | 8/1981 | United Kingdom . |

*Primary Examiner*—Christopher Kent
*Attorney, Agent, or Firm*—Larson & Taylor

[57] ABSTRACT

The outer sides of the widened top embankment part of the gutter are provided with small integral continuous longitudinal channels that face upwards and into which the terminal edge of the waterproof facing of the concrete structure fitted with a drainage channel formed by the gutters in question can be correctly abutted so as to form a leaktight joint between the facing and the gutters laid one after the other and such that the water discharged by the facing into the supplementary channels can also be carried away. The ends and middle part of the gutter are also suitably shaped so that the gutter can be joined to other similar gutters, whether these be whole modules or modules cut into sections of the desired length.

20 Claims, 3 Drawing Sheets

MODULAR GUTTER FOR DRAINAGE CHANNELS

BACKGROUND OF THE INVENTION

1. Field of the Invention

The invention relates to modular plastic gutters that can be assembled to support a grating that is suitable for pedestrians and vehicles, in order to collect and channel drainage water in sports stadia, entrances to garages, underground premises, along curbs and elsewhere.

2. Description of the Related Art

From Italian Utility model Patent application set. No. RM91U 000216 dated Nov. 11, 1991, a gutter is known of the type referred to above that has a male joint element at one end and a female joint element at the other end, of the guillotine type, so that several gutter modules can be laid one after the other to form the channel of the desired length, with a strong, leaktight connection that involves inserting the male joint element of one module into the female joint element of the next module. It is also known for the outer surface of the abovementioned gutters to have pairs of transverse ribs that are spaced an even distance apart with a pitch that is a submultiple of the total length of the module, preferably one tenth of the length, and in which at least the rib nearest the end of the module having the female joint element reproduces a male joint element, so that when the module is cut within the small space located between the paired ribs, the module section terminates with the end produced by the cut and always with a male joint element, so that several modules can be coupled together one after the other, whether they be whole modules or cut-down sections, in order to form a drainage channel of the desired length. The paired ribs are spaced apart at a distance such that they act as a guide for the hacksaw used to cut the gutter down to the desired length. The top edges of the gutter widen outwards into an "L" shape in order to form a recess designed to accommodate a grating that is suitable for pedestrians and/or vehicles.

The main problem of these and other gutters of known type resides in the fact that when the gutters are installed in paving slabs or on other sites having a bituminous protective facing, the facing does not abut tightly against the said gutters and a gap is formed through which water can seep.

SUMMARY OF THE INVENTION

The invention aims to overcome this and other disadvantages of gutters of known type with a novel gutter that can be assembled of the type having a widened top section designed to accommodate a grating that is suitable for pedestrians and/or vehicles and having complementary male and female joint elements, at its ends so that several gutter modules can be coupled together, one after the other, in order to form a drainage channel of the desired length, wherein the outer side of the widened top part of each gutter is provided with corresponding integral continuous longitudinal channels that face in any direction and are shaped such that the terminal edge of the waterproof facing of the structure fitted with the drainage channel formed by the gutters in question can be correctly abutted so as to form a leaktight joint between the said facing and the gutters that are joined one after the other and such that the said joint will also enable the water discharged by the waterproof facing into the said supplementary channels to be carried away.

BRIEF DESCRIPTION OF THE DRAWINGS

Further characteristics and advantages of the invention will become apparent from the following description made with reference to the figures in the drawings, in which.

DESCRIPTION OF THE PREFERRED EMBODIMENT

Figure 3:
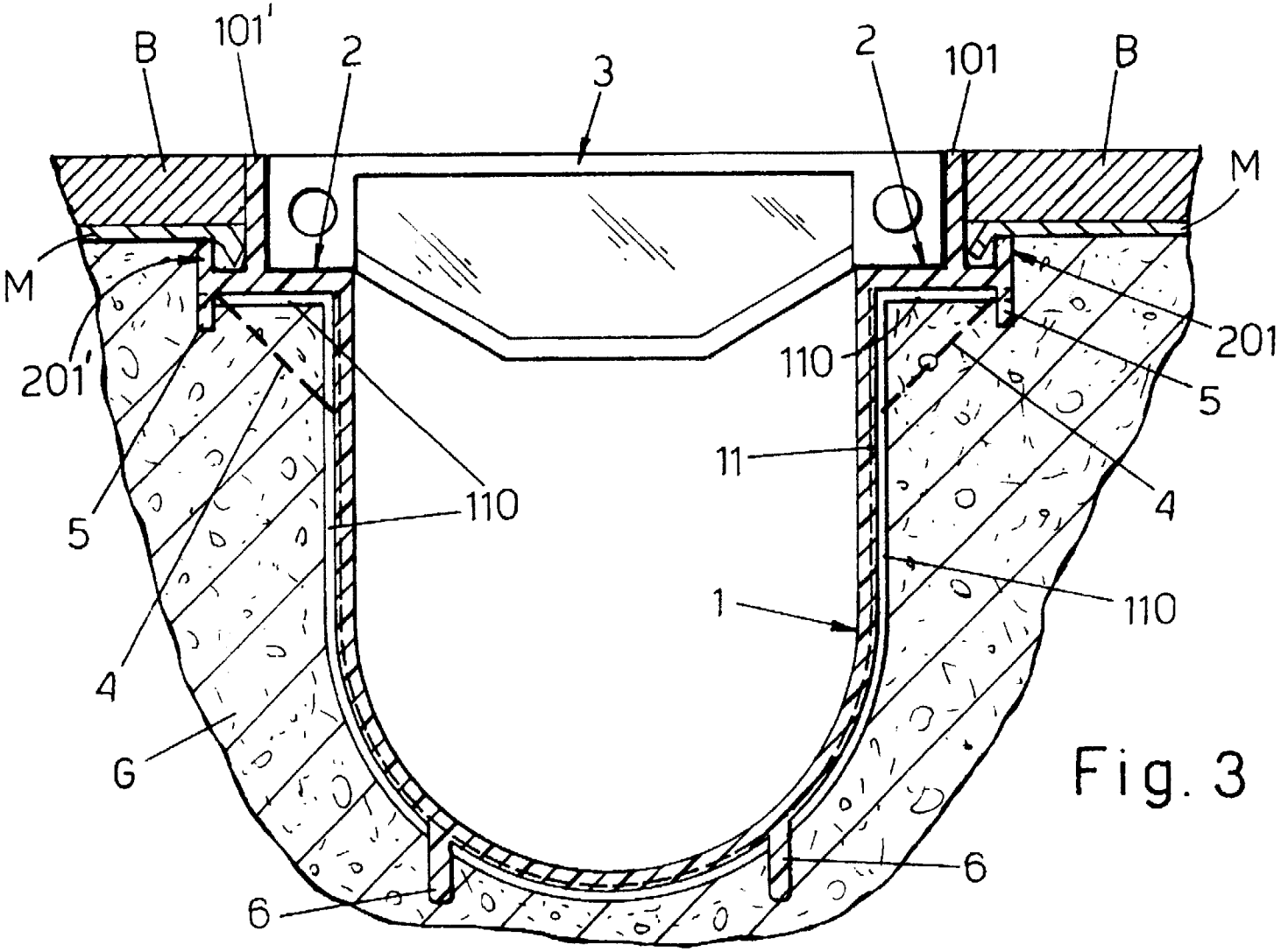
FIG. 3 is a cross-sectional view of the gutter according to the invention taken along the plane III—III of FIG. 1.

From the drawings, it can be seen that the gutter 1 according to the invention, which is preferably made by injecting a suitable plastic, including recycled and filled plastic, into a mould, has an essentially "U"-shaped transverse section and its dimensions can vary depending on the field of application, its capacity and/or other parameters. The top edges 101, 101' of the gutter widen outwards into an "L" shape in order to form a recess 2 having dimensions designed to accommodate a grating 3, of any known type and not necessarily that illustrated in FIG. 3, that is suitable for pedestrians and/or vehicles. According to the invention, on the outside of the said top edges 101, 101' there are small integral continuous longitudinal channels 201, 201' that preferably face upwards and are preferably partly defined by the vertical wall of the said edges, being located towards the bottom of these edges. It is clear from FIG. 3 that it is possible to fold or at least correctly abut the edge of the bituminous facing M, which is normally laid to prevent water seeping into the paving slabs or other sites where the gutter 1 in question may be installed, against the small channels 201, 201' so that any water which collects off the facing is discharged into the said channels 201, 201' which then carry it away at the same suitable slope as the drainage channel. The reference B indicates the usual paved surface laid over the protective facings M. Appropriate transverse stiffening ribs 4 can be provided on the outside of the gutter at the top, in order to join a portion of the side walls of the gutter with the bottom of the top parts 101, 201 and 101', 201'. Additional longitudinal ribs 5 and 6 are provided on the outside of the gutter to ensure that the latter is suitably anchored in the cast concrete G.

Figure 1:
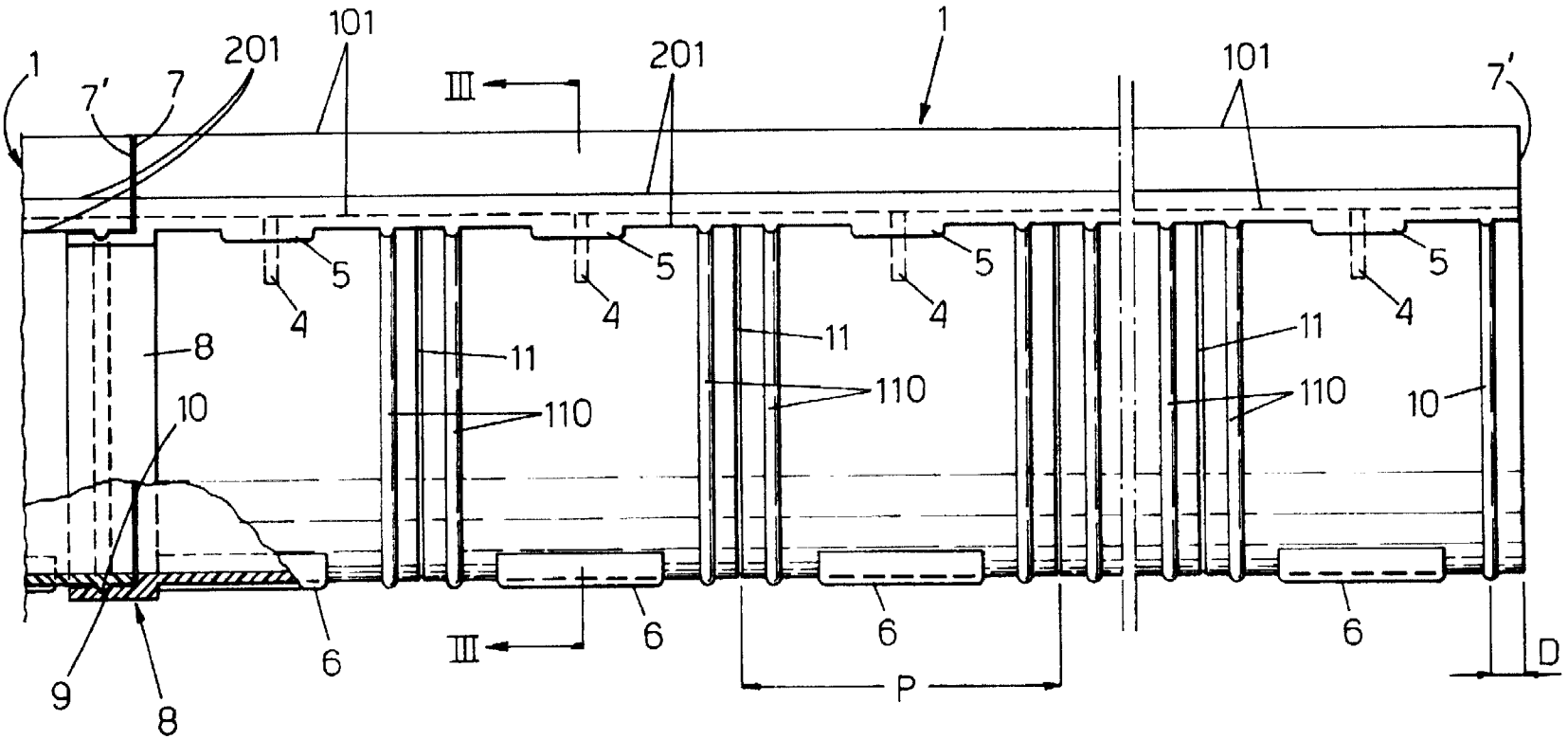
FIG. 1 is a side view of a gutter module according to the invention partially sectioned at the end fitted with the female joint element, via which each gutter module can be connected to the corresponding end with the male joint element of another gutter module.
Figure 2:
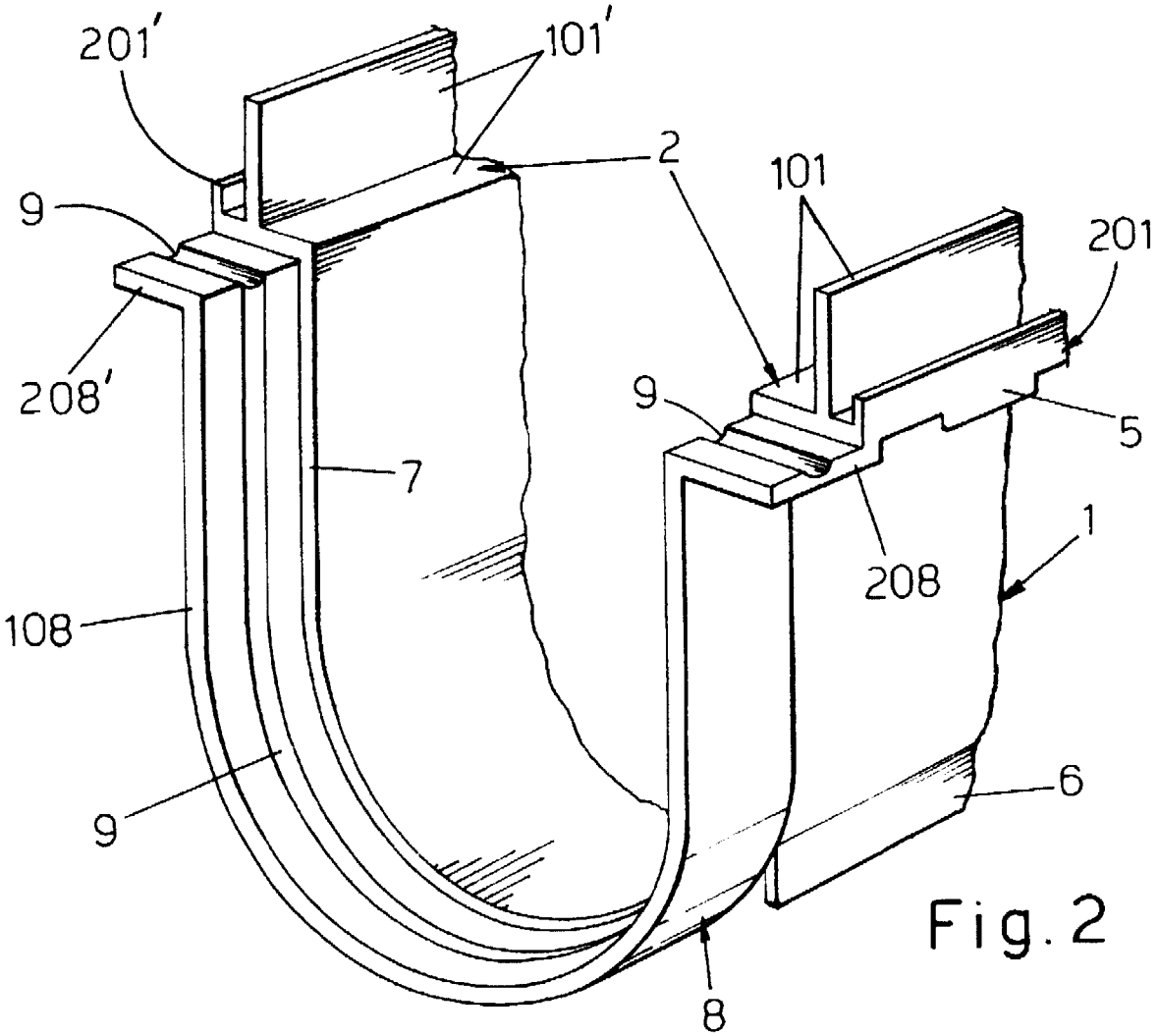
FIG. 2 is a perspective view showing the end of the gutter module with the female joint element in greater detail.

It may be seen from FIGS. 1 and 2 that one end of the gutter 1 terminates in a face 7 that lies in a plane normal to the longitudinal axis of the said gutter and that an integral edge 8 projects out from this face and has a "U"-shaped part 108 in front of the gutter body and horizontal top fins 208, 208' located in front of the base of the top embankment complex 101, 201 and 101', 201'. A continuous transverse groove 9, for example of semicircular shape, runs down the middle of the inside of the edge 8. The gutter end shaped in this way forms the female joint element that enables several gutter modules of the type in question to be coupled together.

The other end of the gutter 1 terminates in a face 7' parallel to the face 7 described above, with the outside of the gutter having a continuous projecting transverse rib 10 of shape complementary to that of the said groove 9 and whose distance D from the adjoining face 7' is essentially equal to the distance between the opposite face 7 and the groove 9. The rib 10 also extends along the bottom of the top complex 101, 201 and 101', 201' of the gutter. This end of the gutter forms the male joint element that enables several gutter modules to be coupled together.

It is quite clear how several gutters of the type described can be laid one after the other, with the end having the rib 10 inserted in and supported by the edge 8, the said rib 10 engaging via a guillotine action with the groove 9 of the said edge 8. The faces 7 and 7' of the successive gutter modules abut against each other. Mastic or silicone can advantageously be inserted between the gutter joints.

To complete the gutter according to the invention, pairs of ribs 110 identical to the end rib 10 referred to above are provided, located on planes perpendicular to the longitudinal axis of the said gutter and spaced an even distance apart with a pitch P which is a submultiple of the length of the said gutter, preferably with a decimal pitch. The pitch P is for example 10 cm and the overall length of the gutter module is for example 50 cm. The distance between the paired ribs 110 is essentially twice the said distance D between the projection 10 and the adjacent face 7'. A continuous groove 11, which forms a useful guide for the hacksaw used to reduce the length of the gutter by the required amount as and when this proves necessary, runs down the middle of the space between the said ribs 110, parallel to them. The groove 11 preferably runs solely round the body of the gutter 1, however, it should be understood that it may also extend along the bottom of the top embankment complex 101, 201 and 101', 201'. When the gutter is cut along a groove 11, the resulting gutter sections have a rib 110 at one end which replaces the original rib 10 of the complete module so that this said end of the section can be coupled to the end with the groove 9, referred to above, of a whole module or of a similarly cut-down gutter section. Even sections that happen to have male coupling parts at both ends can be used to complete a drainage channel.

I claim:

1. A modular gutter comprising:

axial ends having respective complementary male and female joint elements such that a plurality of said gutters can be longitudinally coupled together to form a drainage channel of a desired length;

respective longitudinal side walls extending between said axial ends and having respective tops spaced from one another such that said side walls define therebetween a longitudinal portion of the drainage channel embedded in a laterally surrounding material up to said tops;

a respective widened top section provided at the respective top of each respective said longitudinal side wall such that a grating is supported laterally between the respective said top sections; and a respective supplemental channel located laterally outward from each respective said top section and integral therewith, each said supplemental channel being continuous from said male joint element to said female joint element such that water collected therein is channeled to flow longitudinally.

2. A modular gutter as claimed in claim 1:

wherein each respective said top section includes a respective laterally outward vertical wall; and wherein each respective said supplemental channel is U-shaped in lateral cross section, has a respective open top, and has a respective vertical side portion formed by the respective said vertical wall of the respective said top section.

3. A modular gutter as claimed in claim 2:

wherein each respective said top section includes a respective horizontal wall extending interiorly of the respective said vertical wall; and wherein each respective said supplemental channel includes a respective outer side wall spaced exteriorly from an adjacent respective said outward vertical wall of the respective said top section, each respective said outer side wall having a respective vertical height which is lower than a respective vertical height of the adjacent respective said outward vertical wall above the respective said horizontal wall.

4. A modular gutter as claimed in claim 3:

wherein each respective said supplemental channel includes a respective bottom wall which is coplanar with an adjacent respective said horizontal wall of the respective said top section; and wherein each respective said outer side wall of the respective said supplemental channel is parallel to an adjacent respective said outward vertical wall of the respective said top section.

5. A modular gutter as claimed in claim 4 and further including:

a respective plurality of transverse ribs extending from each respective said longitudinal side wall to an adjacent respective said bottom wall and associated respective said horizontal wall, said transverse ribs along each respective said longitudinal wall being spaced symmetrically along a length of each respective said longitudinal side wall.

6. A modular gutter as claimed in claim 5:

wherein each respective said outer side wall includes a respective series of first depending ribs spaced along a length thereof to help anchor the gutter in place; and wherein each respective said longitudinal side wall includes a respective plurality of second depending ribs extending downwardly and outwardly therefrom to help anchor the gutter in place.

7. A modular gutter as claimed in claim 6:

wherein each respective said transverse rib is joined perpendicularly to an associated respective said second depending rib.

8. A modular gutter as claimed in claim 7:

wherein said male joint element includes a male end face perpendicular to a longitudinal axis between said axial ends, said male end face defining first ends of said longitudinal side walls, of said horizontal walls and of said bottom walls, and a continuous transverse rib provided exteriorly along said longitudinal walls, said horizontal walls and said bottom walls, said transverse rib being parallel to said male end face and positioned a short predetermined distance from said male end face; and wherein said female joint element includes a female end face perpendicular to the longitudinal axis between said axial ends, said female end face defining second ends of said longitudinal side walls, of said horizontal walls and of said bottom walls, an integral collar projecting longitudinally away from said female end face to a distance about twice that of the short predetermined distance, said integral collar having an internal profile in cross section which mates with an external profile in cross section of said longitudinal walls, of said horizontal walls and of said bottom walls such that when the plurality of said gutters are coupled together said male and female end faces abut one another, and a continuous transverse groove provided along an interior face of said collar at the short predetermined distance from said female end face, said transverse groove being complementary shaped to said transverse rib such that said transverse rib of one said gutter is inserted in said transverse groove of a successive said gutter with a guillotine action when two said gutters are coupled together.

9. A modular gutter as claimed in claim 8:

wherein said longitudinal side walls connect together at a bottom and include a plurality of pairs of continuous second transverse ribs provided in an outer lateral surface of said longitudinal walls, each said pair being positioned longitudinally along said longitudinal side walls at a separation distance which is a submultiple of the length of said longitudinal side walls, and each said second transverse rib of each said pair spaced two of the short predetermined distances apart and having a cross section which is identical to that of a cross section of a first-mentioned said transverse rib, and a continuous second transverse groove provided midway between each said pair of second transverse ribs which said transverse groove serves as a cutting guide such that said gutter can be cut to a shortened gutter section.

10. A modular gutter as claimed in claim 9:

wherein said second transverse ribs extend along said bottom walls and said horizontal walls; and wherein said second transverse grooves terminate at said horizontal walls.

11. A modular gutter system comprising:

a plurality of longitudinal modular gutters which are longitudinally connected together to form the drainage channel of a desired length, each said modular gutter including axial ends having respective complementary male and female joint elements to provide a joint between one said modular gutter coupled to another said modular gutter, respective longitudinal side walls extending between said axial ends and having respective tops spaced from one another such that said side walls define therebetween a longitudinal portion of the drainage channel, a respective widened top section provided at the respective top of each respective said longitudinal side wall, and a respective supplemental channel located laterally outward from each respective said top section and integral therewith, each said supplemental channel being continuous from said male joint element to said female joint element such that water collected therein is channeled to flow longitudinally;

a base material in which said modular gutters are embedded, said base material extending up to said supplemental channels of said modular gutters;

a waterproof facing provided on a top surface of said base material, said waterproof facing having respective terminal edges which extend into respective said supplemental channels such that any water flowing about said terminal edges of said waterproof facing falls into said supplemental channels to be channeled away;

a top material applied on top of said waterproof facing up to said widened top sections; and a grating which is supported laterally between the respective said top sections.

12. A modular gutter system as claimed in claim 11:

wherein each respective said top section includes a respective laterally outward vertical wall; and wherein each respective said supplemental channel is U-shaped in lateral cross section, has a respective open top, and has a respective vertical side portion formed by the respective said vertical wall of the respective said top section.

13. A modular gutter system as claimed in claim 12:

wherein each respective said top section includes a respective horizontal wall extending interiorly of the respective said vertical wall; and wherein each respective said supplemental channel includes a respective outer side wall spaced exteriorly from an adjacent respective said outward vertical wall of the respective said top section, each respective said outer side wall having a respective vertical height which is lower than a respective vertical height of the adjacent respective said outward vertical wall above the respective said horizontal wall.

14. A modular gutter system as claimed in claim 13:

wherein each respective said supplemental channel includes a respective bottom wall which is coplanar with an adjacent respective said horizontal wall of the respective said top section; and wherein each respective said outer side wall of the respective said supplemental channel is parallel to an adjacent respective said outward vertical wall of the respective said top section.

15. A modular gutter system as claimed in claim 14 and further including:

a respective plurality of transverse ribs extending from each respective said longitudinal side wall to an adjacent respective said bottom wall and associated respective said horizontal wall, said transverse ribs along each respective said longitudinal wall being spaced symmetrically along a length of each respective said longitudinal side wall.

16. A modular gutter system as claimed in claim 15:

wherein each respective said outer side wall includes a respective series of first depending ribs spaced along a length thereof to help anchor each said modular gutter in place in said base material; and wherein each respective said longitudinal side wall includes a respective plurality of second depending ribs extending downwardly and outwardly therefrom to help anchor each said modular gutter in place in said base material.

17. A modular gutter system as claimed in claim 16:

wherein each respective said transverse rib is joined perpendicularly to an associated respective said second depending rib.

18. A modular gutter system as claimed in claim 17:

wherein each said male joint element of a respective said modular gutter includes a male end face perpendicular to a longitudinal axis between said axial ends, said male end face defining first ends of said longitudinal side walls, of said horizontal walls and of said bottom walls, and a continuous transverse rib provided exteriorly along said longitudinal walls, said horizontal walls and said bottom walls, said transverse rib being parallel to said male end face and positioned a short predetermined distance from said male end face; and wherein each said female joint element of the respective said modular gutter includes a female end face perpendicular to the longitudinal axis between said axial ends, said female end face defining second ends of said longitudinal side walls, of said horizontal walls and of said bottom walls, an integral collar projecting longitudinally away from said female end face to a distance about twice that of the short predetermined distance, said integral collar having an internal profile in cross section which mates with an external profile in cross section of said longitudinal walls, of said horizontal walls and of said bottom walls such that when the plurality of said gutters are coupled together said male and female end faces abut one another, and a continuous transverse groove provided along an interior face of said collar at the short predetermined distance from said female end face, said transverse groove being complementary shaped to said transverse rib such that said transverse rib of one said gutter is inserted in said transverse groove of a successive said gutter with a guillotine action when two said gutters are coupled together.

19. A modular gutter system as claimed in claim 18:

wherein respective said longitudinal side walls of each said modular gutter connect together at a bottom and include a plurality of pairs of continuous second transverse ribs provided in an outer lateral surface of said longitudinal walls, each said pair being positioned longitudinally along said longitudinal side walls at a separation distance which is a submultiple of the length of said longitudinal side walls, and each said second transverse rib of each said pair spaced two of the short predetermined distances apart and having a cross section which is identical to that of a cross section of a first-mentioned said transverse rib, and a continuous second transverse groove provided midway between each said pair of second transverse ribs which said transverse groove serves as a cutting guide such that said gutter can be cut to a shortened gutter section.

20. A modular gutter system as claimed in claim 19:

wherein said second transverse ribs extend along said bottom walls and said horizontal walls; and wherein said second transverse grooves terminate at said horizontal walls.

* * * * *